US005174262A

United States Patent [19]

Staerzl

[11] Patent Number: 5,174,262

[45] Date of Patent: Dec. 29, 1992

[54] CONTROL VALVE FOR FUEL INJECTION

[75] Inventor: Richard E. Staerzl, Fond du Lac, Wis.

[73] Assignee: Brunswick Corporation, Skokie, Ill.

[21] Appl. No.: 709,081

[22] Filed: May 30, 1991

Related U.S. Application Data

[63] Continuation of Ser. No. 339,205, Apr. 14, 1989, abandoned.

[51] Int. Cl.[5] ..... F02M 41/00

[52] U.S. Cl. ..... 123/458; 251/129.15; 123/73 A; 123/510

[58] Field of Search ..... 123/458, 510, 73 A; 251/129.15

[56] References Cited

U.S. PATENT DOCUMENTS

| | | | |
|---|---|---|---|
| 3,842,809 | 10/1974 | King | 123/458 |
| 3,844,263 | 10/1974 | Endo | 123/458 |
| 4,305,351 | 12/1981 | Staerzl . | |
| 4,501,241 | 2/1985 | Nolte | 251/129.15 |
| 4,509,716 | 4/1985 | Barber | 251/129.15 |
| 4,563,133 | 1/1986 | Yasuhara | 123/458 |
| 4,720,078 | 1/1988 | Nakamura | 251/129.15 |
| 4,763,626 | 8/1988 | Staerzl . | |
| 4,777,913 | 10/1988 | Straerzl et al. | 123/447 |
| 4,829,964 | 5/1989 | Asayama | 123/458 |
| 4,836,248 | 6/1989 | Stegmaier | 251/129.15 |

FOREIGN PATENT DOCUMENTS

| | | | |
|---|---|---|---|
| 1300181 | 3/1987 | U.S.S.R. | 123/458 |

*Primary Examiner*—Carl S. Miller

*Attorney, Agent, or Firm*—Lockwood, Alex, FitzGibbon & Cummings

[57] ABSTRACT

A fuel control solenoid valve for metering fuel flow through a low pressure fuel injection system of an internal combustion system is provided. The low pressure fuel injection system including the fuel flow solenoid valve is especially suitable for use in providing fuel to a two-cycle internal combustion engine, particularly those that are suitable for use as marine outboard motors. The fuel control solenoid valve includes a non-magnetic spacer which substantially prevents the development of engine surging as peak power conditions are approached or reached.

5 Claims, 3 Drawing Sheets

CONTROL VALVE FOR FUEL INJECTION

This application is a continuation of application Ser. No. 339,205, filed Apr. 14, 1989, now abandoned.

DESCRIPTION

Background and Summary of the Invention

The present invention generally relates to an improved control valve for a fuel injection system, as well as to a fuel injection system incorporating same. More particularly, the invention relates to low pressure fuel injection systems for internal combustion engines which incorporate metering means for controlling the flow of fuel to the cylinder or cylinders of the engine. The metering means includes a solenoid-type control valve which incorporates a component for improving dither mode performance of the control valve and of the fuel injection system.

Fuel injection systems for internal combustion engines have been developed which eliminate the need for high pressure components, such as high pressure fuel injectors, a high pressure fuel pump, and a constant fuel pressure regulator. Such systems can be characterized as low pressure fuel injection systems. Exemplary publications in this regard include Staerzl U.S. Pat. No. 4,305,351 and U.S. Pat. No. 4,763,626, the subject matter thereof being incorporated by reference hereinto. In systems of this type, a low pressure fuel pump is upstream of a solenoid valve, which valve controls fuel passage to the cylinders in response to the demand for fuel flow determined by throttle position, and/or other inputs. Low pressure fuel injection systems of this general type exhibit many advantages, and they are particularly suitable for providing fuel to two-cycle internal combustion engines, and especially internal combustion engines that are incorporated into marine outboard motors.

Despite the very advantageous aspects of low pressure fuel injection systems, a difficulty has been experienced. During peak power demands, at times the fuel input into the cylinders exceeds that called for by the throttle position and/or other inputs. More specifically, when the controls of the fuel injection system call for fuel input that is high in flow volume, but somewhat short of a fully open volume, fuel flow volume in excess of that called for is at times experienced in a precipitous and generally uncontrolled manner. Thereafter, an abrupt fuel flow decrease can be experienced. The operator of the internal combustion engine thereby observes unintended and generally uncontrolled surging of engine speed. This experience can be particularly disquieting inasmuch as it tends to appear during times of peak power demand, even if fuel flow operation had been extremely well controlled at lower power demand levels.

Various measures have been taken in an attempt to solve this high power surging phenomenon. Those attempts have included adjusting and/or modifying electronic controls of the fuel injection system, such as re-tuning the amplifiers in the system so that they would have a desired gain and response in order to attempt to prevent this surging or oscillation in fuel flow. Attempts of this type have been limited in their effectiveness, and this surging or oscillation phenomenon continued to be observed, especially when the fuel flow volume was upwards of 70% or 80% or more of the fully open flow volume.

It has now been discovered that the approach taken by the present invention has solved this surging or fuel flow oscillation problem. By practicing the present invention, it is possible to operate a low pressure fuel injection system under tight fuel flow control, even at these high to peak power conditions. The low pressure fuel injection system according to the present invention incorporates a fuel control solenoid valve device which provides a spacer that enhances the ability of the fuel control solenoid valve device to operate in a dither mode without experiencing engine surging or substantial oscillation of fuel flow through the low pressure fuel injection system. In accordance with the present invention, a non-magnetic spacer component is positioned within a gap adjacent to an armature of the fuel control solenoid valve device which moves through the gap during operation of the fuel controlled solenoid valve.

It is a general object of the present invention to provide an improved fuel control solenoid valve device and a low pressure fuel injection system incorporating same.

Another object of the present invention is to provide an improved fuel control solenoid valve device for metering fuel flow through a low pressure fuel injection system of an internal combustion engine.

Another object of this invention is to provide an improved fuel control solenoid valve exhibiting improved performance when operated in a dither mode.

Another object of the present invention is to provide an improved fuel control solenoid valve for a low pressure fuel injection system which maintains a linear functionality between fuel flow therethrough and the duty cycle of the coil excitation pulse.

Another object of the present invention is to provide an improved fuel control solenoid valve for a low pressure fuel injection system which avoids having reduced magnetic reluctance result in open condition latching of its armature even at and near peak power operation.

Another object of the present invention is to provide an improved low pressure fuel injection system for an internal combustion engine, which system provides a linearly controllable fuel flow throughout its operational range, even at peak power ranges.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
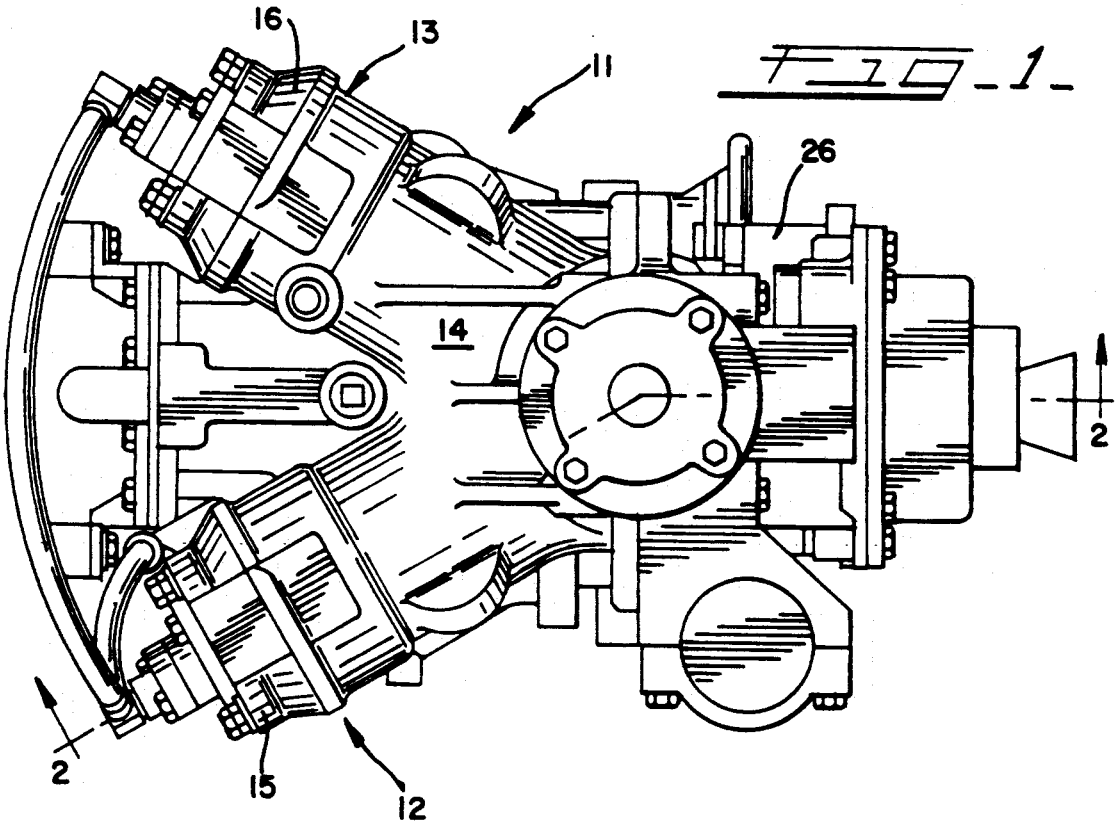
FIG. 1 is an end elevational view of an internal combustion engine of the type incorporated into marine outboard motors.

With reference to FIG. 1, a two-cycle V-6 engine having two banks of three cylinders at 60° angular separation is generally designated as 11. Two banks of cylinders, generally designated as 12 and 13, are illustrated. An engine block 14 includes cylinder heads 15 and 16. While the overall construction of the engine 11 will be appreciated by those skilled in the art, further details are illustrated in FIG. 2.

Figure 2:
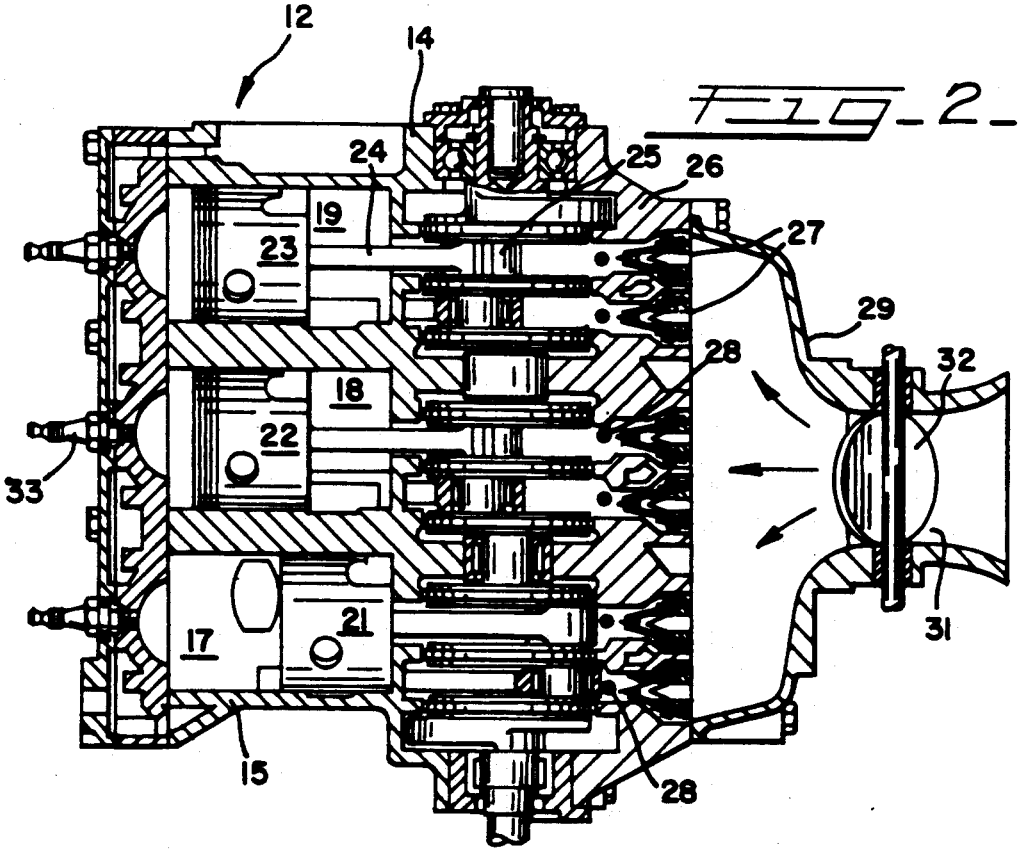
FIG. 2 is a cross-sectional view generally along the line 2—2 of FIG. 1 and illustrating a portion of an embodiment of a low pressure fuel injection system.

As can be seen in FIG. 2, a plurality of cylinders 17, 18 and 19 are formed within the cylinder head 15, and pistons 21, 22 and 23, respectively, are mounted therewithin in the customary manner. Connecting rods 24 secure each piston to a crankshaft assembly 25 in a generally known manner. It will be observed that the crankshaft assembly 25 is generally vertically oriented, and the pistons 21, 22, 23 and cylinders 17, 18, 19 are generally horizontally oriented such that they are vertically positioned with respect to each other. A fuel/air supply block 26 supports a bank of one-way reed valve assemblies 27 of a generally known construction. A plurality of fuel injector tips 28 are positioned in this embodiment at a location upstream of each reed valve assembly 27. An air intake manifold 29 is secured to the fuel/air supply block 26 and defines the air intake flow path as illustrated by the arrows.

Incoming air passes through a venturi 31 having a butterfly valve 32 for controlling the volume of air flowing into the air intake manifold 29. Air flowing through the venturi 31 is accelerated toward and passes through each reed valve assembly 27, after which the flowing air mixes with fuel entering the fuel/air supply block 26 through the respective fuel injector tips 28 in order to thereby provide the needed fuel and air mixture for passage to the cylinders, 17, 18, 19 and for timed ignition by spark plugs 33 or the like in a well-known manner.

Figure 3:
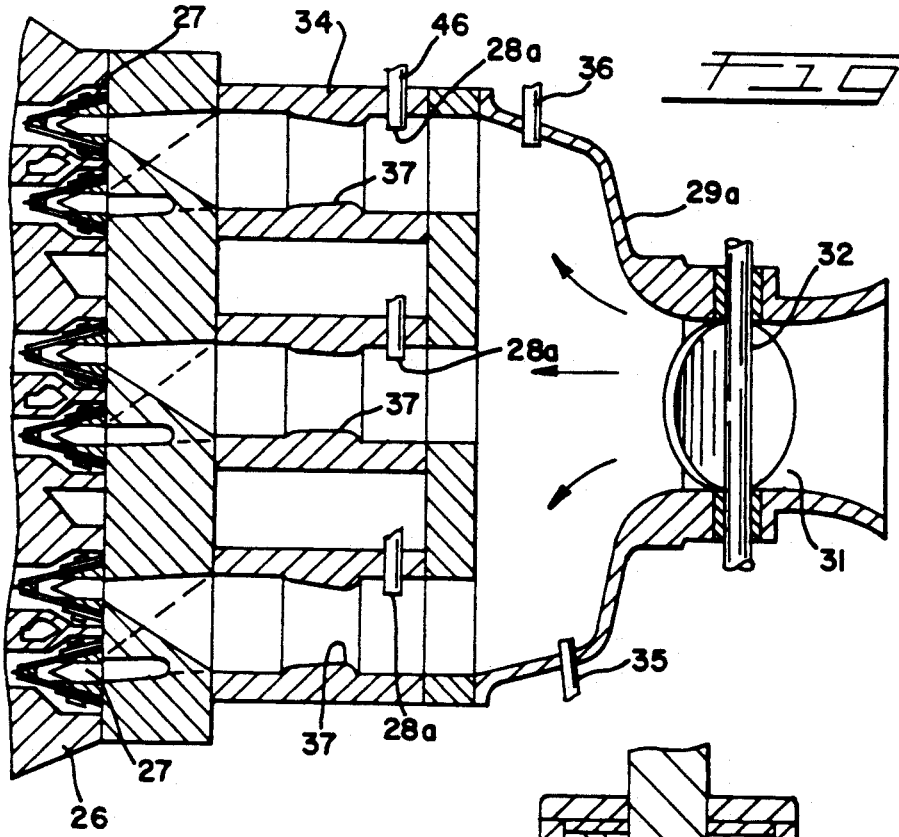
FIG. 3 is a cross-sectional view generally on the order of FIG. 2 and illustrating another embodiment of a portion of a low pressure fuel injection system.

FIG. 3 illustrates a somewhat different embodiment wherein a venturi assembly 34 is positioned between the fuel/air supply block 26 and air intake manifold **29*a*. Fuel injector tips 28*a* open into the venturi assembly 34. Venturi assembly 34 receives air from the intake manifold 29*a*, atomizes fuel from the outlets or injector tips 28*a*, and delivers the fuel/air mixture to the respective cylinders downstream of the one-way reed valve assemblies 27. Tube 35 senses pressure generally at the outlets or injector tips 28*a* by sensing the pressure in the air intake manifold 29*a*, which is at substantially the same pressure. An air line 36** cooperates with other components schematically shown in FIG. 4 to prevent siphoning of fuel which may otherwise occur because the cylinders are at different heights.

Figure 4:
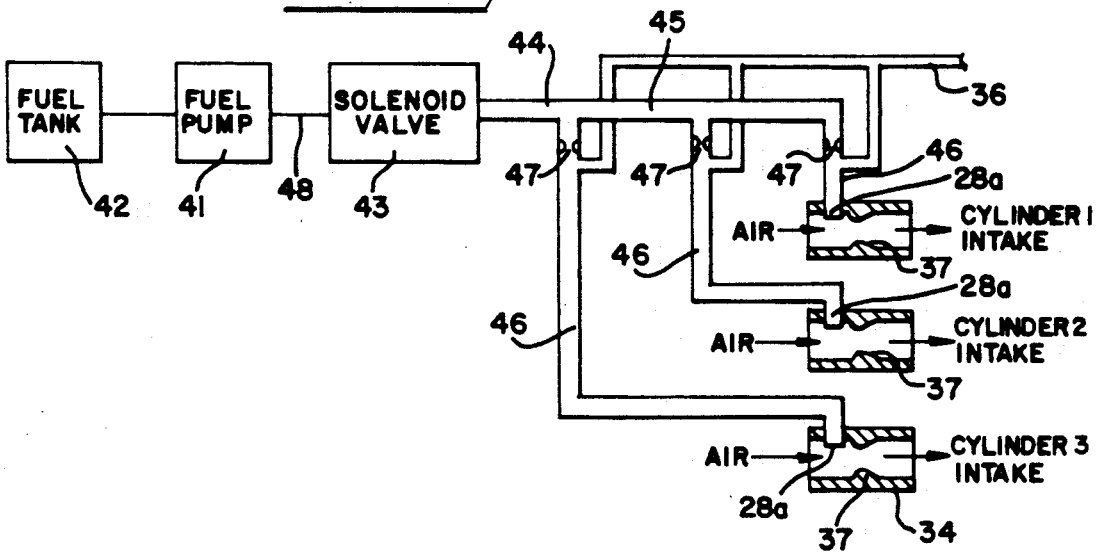
FIG. 4 is a schematic view illustrating a typical low pressure fuel injection system for an internal combustion engine.

With more particular reference to FIG. 4, this schematically illustrates a low pressure fuel injection system. While certain particulars thereof are somewhat specific to the embodiment illustrated in FIG. 3, this is done merely in order to fully illustrate this particular type of low pressure fuel injection system. A low pressure fuel pump 41 directs fuel from the fuel tank 42 to a solenoid valve assembly 43, which is in accordance with the present invention. Solenoid valve assembly 43 meters the fuel into a fuel line 44 for supplying fuel to a fuel rail 45, which feeds each of the cylinders through respective parallel passages 46.

In the embodiment illustrated in FIGS. 3 and 4, each passage 46 has an orifice 47 having a restricted diameter in order to produce a fuel pressure drop thereacross. Venturi assembly 34 includes a restrictive portion 37, and the outlets or fuel injector tips **28*a*** inject the fuel closely upstream thereof.

It is to be appreciated that FIGS. 2, 3 and 4 illustrate low pressure fuel injection systems for internal combustion engines, particularly for marine outboard motors. They are not intended to explicitly describe every type of low pressure fuel injection system or every type of low pressure fuel injection system incorporating the features of the present invention.

Figure 5:
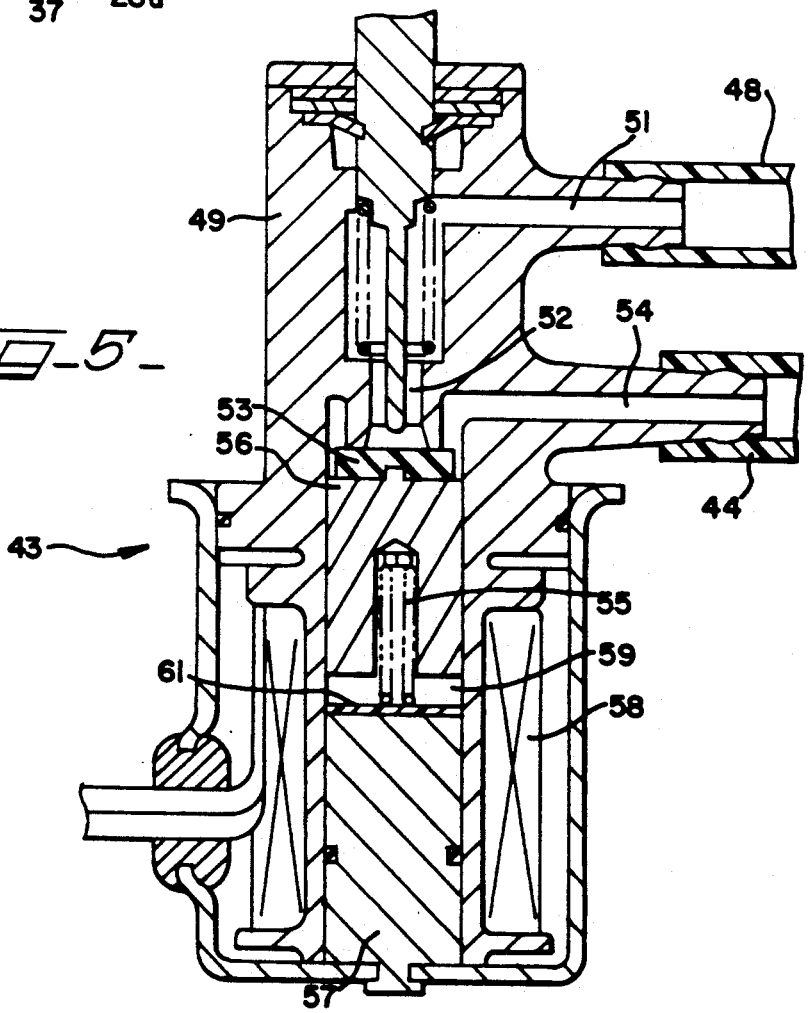
FIG. 5 is a cross-sectional view of a solenoid valve device of the type incorporated into the low pressure fuel injection systems according to the present invention.

A preferred solenoid valve assembly 43 in accordance with the present invention is shown in FIG. 5. Line 48 provides fuel from the fuel pump 41 into inlet port 51 of the solenoid valve assembly 43. Fuel from inlet port 51 flows into bore 52 in valve body 49. Further flow of fuel is prevented by a seal 53 when it is in the closed orientation as illustrated in FIG. 5. When seal 53 moves downwardly, fuel then flows into an outlet port 54 and into the fuel line 44 for eventual passage to the cylinders. Thus, the flow of fuel from the fuel tank 42 to the fuel rail 45 and beyond is metered according to the position of the seal 53.

Seal 53 in this embodiment is biased in its illustrated closed orientation by a suitable biasing component 55 such as a spring assembly. Controlled movement of the seal 53 in opposition to the biasing component 55 is accomplished by a suitable solenoid assembly. The solenoid assembly that is illustrated in FIG. 5 includes an armature 56 which supports the seal 53 within valve body 49. A pole piece 57 and a coil 58 are secured to the valve body 49, and a gap 59 is provided between the movable armature 56 and the pole piece 57. A non-magnetic spacer component 61 is positioned within the gap 59 in a manner such that the opposing surfaces of the armature 56 and the pole piece 57 will not touch each other. In addition, the spacer component 61 provides non-magnetic spacing between these opposing surfaces whereby a certain degree of non-magnetic insulation is provided between the armature 56 and the pole piece 57.

During operation of a solenoid valve assembly within a fuel injection system, the position of the armature 56 and hence of the seal 53 is controlled by the duty cycle of the excitation pulse of the coil 58. Positioning of the seal 53, of course, meters fuel flow out of the outlet port 54 and hence to the cylinders 17, 18, 19. It is important to maintain a substantially linear relationship between fuel flow and the duty cycle of the coil excitation pulse. In this manner, the operator of the internal combustion engine can expect a close relationship between actual fuel flow out of the outlet port 54 and the fuel flow that is indicated by suitable fuel control mechanisms, such as a throttle or the like and any associated mechanical and electronic components. This relationship should be maintained throughout the range of operation of the solenoid valve and associated fuel flow components. It is especially important that this relationship be maintained during the dither mode of the fuel control solenoid.

It has been determined that, prior to the present invention, this type of substantially linear relationship was not consistently experienced. Instead, engine surging would be experienced, particularly under peak power conditions. An illustration of this disadvantageous relationship is found in FIG. 6. This is a plot of duty cycle versus fuel flow of a typical internal combustion engine low pressure fuel injection system that is not in accordance with the present invention. Curve A shows the substantially linear relationship between fuel flow and the duty cycle of the coil excitation pulse. This relationship has been found to generally continue in a typical situation until point B is reached, at which time fuel flow increases substantially immediately to the maximum level without any significant increase in duty cycle input. At this point, surging of the internal combustion engine begins to be experienced. At or near peak fuel flow, the duty cycle is cut back, and a substantial amount of energy is removed. At some point, for example location C, the fuel flow abruptly decreases, as illustrated by curve D to a level that is typically below that at which the engine surging was first experienced. At some point, illustrated as position E, the substantially linear relationship once again takes effect.

This engine surging phenomenon can thus be characterized as one that follows a hysteresis loop. It had been considered that this hysteresis loop would be controlled by suitable modification and/or adjustment of the electronic controls associated with the low pressure fuel injection system. Such attempts were not adequately satisfactory.

Figure 6:
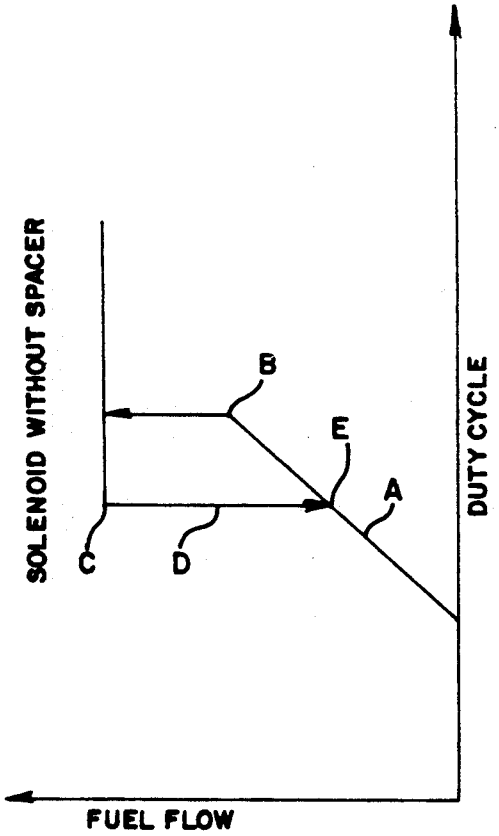
FIG. 6 is a plot illustrating the relationship between fuel flow and duty cycle, the plot including a hysteresis loop that is characteristic of a fuel injection system which is not in accordance with the present invention.
Figure 7:
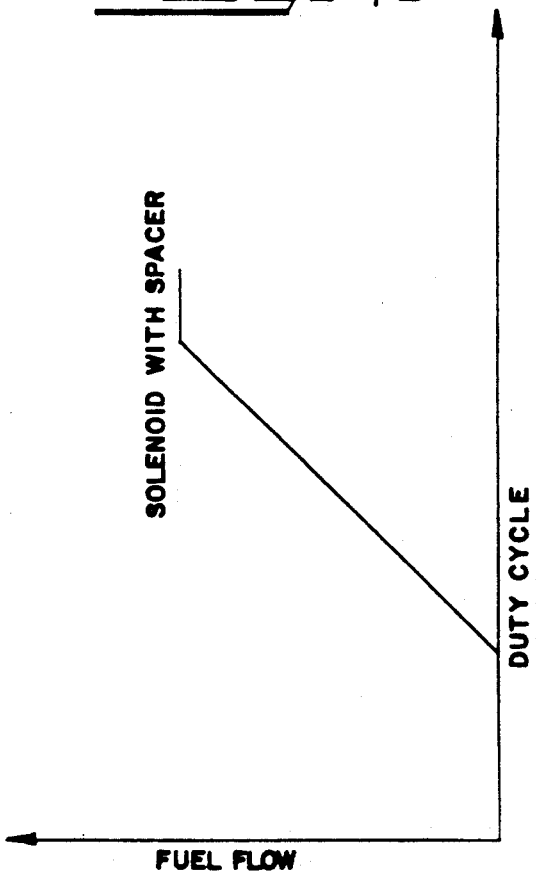
FIG. 7 is a plot of fuel flow versus duty cycle which illustrates a substantially linear relationship between fuel flow and duty cycle for a low pressure fuel injection system according to the present invention.

FIG. 7 illustrates the substantially linear relationship between the duty cycle of the excitation pulse of coil 58 versus fuel flow out of the outlet port 54 when the present invention is practiced. The substantially linear curve illustrated continues until at substantially peak power, at which time the fuel flow levels off at wide open fuel flow that is characteristic of a full throttle condition. The primary cause for the difference between the hysteresis loop, engine surging condition depicted by FIG. 6 and the substantially linear, smooth engine operation condition illustrated in FIG. 7 is the addition of the spacer component 61 to the solenoid valve assembly 43. FIG. 7 illustrates the linear and continuous movement of the armature 56, and hence the seal 53, toward the pole piece 57 (in a downward direction according to the orientation of FIG. 5), which movement is effected by modifying the duty cycle of the solenoid assembly in accordance with generally known principles. The result is a controlled, linear movement which reduces the gap 59 until such time as there is engagement between the opposing surfaces of the armature 56 and of the spacer component 61.

This controlled operation is a substantial improvement over that illustrated in FIG. 6. Both plots illustrate operation of the fuel control solenoid valve in a dither mode, during which the position of the armature is to be controlled by the duty cycle of the coil excitation pulse. In the prior art arrangement illustrated in FIG. 6, this is a linear function until the armature comes close to the pole piece, which is typically experienced at the position where the solenoid valve has moved to a location at which it is open to at least about 70% or 80% or more of its movement range between fully closed and fully opened. This is illustrated at location B in FIG. 6, at which point it has been determined the armature snaps to its fully opened condition and up to curve C. When this condition is reached, the reduced magnetic reluctance causes the armature to latch to the pole piece. Thereafter, peak fuel flow continues until a substantial amount of energy is removed, at which time the armature abruptly snaps away and out of its engagement with the pole piece of the solenoid. Fuel flow continues to abruptly reduce until location E is reached, and the hysteresis loop of this step function is completed.

With more particular reference to the spacer component 61, it is made of a non-magnetic material which will limit the magnetic reluctance. Typically suitable materials include Delrin, Mylar and nylon. Also included can be non-magnetic metals, such as brass and the like. It has been found that, when the spacer component is made of synthetic materials, its thickness should be on the order of between roughly 5 thousandths and about 15 thousandths of an inch. An especially preferred spacer component 61 for the type of solenoid valve assembly 43 which is illustrated herein is a solid disc of Mylar having a thickness of between approximately 6 and 10 thousandths of an inch, most preferably on the order of 8 thousandths of an inch.

It will be understood that the embodiments of the present invention which have been described are illustrative of some of the applications of the principles of the present invention. Numerous modifications may be made by those skilled in the art without departing from the true spirit and scope of the invention.

I claim:

1. A low pressure fuel injection system for a two-cycle internal combustion engine, the low pressure fuel injection system comprising:

a fuel line;

low pressure fuel pump means for supplying low pressure fuel to said fuel line to transport the fuel from a fuel supply to a cylinder of the two-cycle internal combustion engine;

fuel control solenoid valve means in said fuel line, said fuel control solenoid valve means metering the low pressure fuel flow to the cylinder;

said fuel control solenoid valve means including means therein for varying fuel flow through said fuel control solenoid valve means between a fully opened mode, a fully closed mode and various modes intermediate of said fully opened mode and said fully closed mode;

said fuel flow varying means including an armature and a pole piece at least one of which is movable relative to the other and having a gap therebetween, and magnetic flux actuation means having a duty cycle for selectively and adjustably varying the height of said gap over a plurality of differing heights between a minimum height when said solenoid valve means is in said fully opened mode and a maximum height when said solenoid valve means is in said fully closed mode to provide said various intermediate modes; and non-magnetic spacer means positioned within said gap for maintaining spacing between said pole piece and said armature, for providing non-magnetic insulation between said pole piece and said armature, and for maintaining a substantially linear relationship between the duty cycle of the magnetic flux actuator means and said selectively and adjustably varying low pressure fuel flow to the cylinder between said maximum and minimum gap heights and as said gap height is approaching its minimum height when said solenoid valve is approaching said fully opened mode to prevent surging of the engine as said valve approaches said fully opened mode.

2. The low pressure fuel injection system according to claim 1, wherein the internal combustion engine is a two-cycle marine outboard motor.

3. The low pressure fuel injection system according to claim 1, wherein said armature is slidably movable and biased so as to impart the fully closed mode to the fuel control solenoid valve means.

4. The low pressure fuel injection system according to claim 1, wherein said non-magnetic spacer means is, at substantially all times, in engagement with a surface of said pole piece which is opposite to an opposing surface of said armature.

5. The low pressure fuel injection system according to claim 4, wherein said non-magnetic spacer means is a flat component having a thickness between approximately 5 thousandths and 15 thousandths of an inch.

* * * * *